US008256887B2

(12) United States Patent
Zhou et al.

(10) Patent No.: US 8,256,887 B2
(45) Date of Patent: Sep. 4, 2012

(54) COMPOSITION, METHOD AND SYSTEM FOR MAKING HIGH WHITENESS INKJET MEDIA

(75) Inventors: Xiaoqi Zhou, San Diego, CA (US); Emilio Adan, Carlsbad, CA (US); David Favela Aguilera, San Diego, CA (US); Xulong Fu, San Diego, CA (US); Hai Quang Tran, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 247 days.

(21) Appl. No.: 12/921,387

(22) PCT Filed: Mar. 7, 2008

(86) PCT No.: PCT/US2008/056237

§ 371 (c)(1), (2), (4) Date: Sep. 7, 2010

(87) PCT Pub. No.: WO2009/110910

PCT Pub. Date: Sep. 11, 2009

(65) Prior Publication Data

US 2011/0012970 A1 Jan. 20, 2011

(51) Int. Cl.

| | |
|---|---|
| ***B41J 2/01*** | (2006.01) |
| ***B41J 29/38*** | (2006.01) |
| ***B41J 2/14*** | (2006.01) |
| ***B44C 1/17*** | (2006.01) |

(52) U.S. Cl. ..... 347/101; 347/9; 347/52; 156/235

(58) Field of Classification Search ..... None
See application file for complete search history.

(56) References Cited

U.S. PATENT DOCUMENTS

| | | | |
|---|---|---|---|
| 3,676,338 | A | 7/1972 | Fries et al. |
| 6,777,039 | B2 | 8/2004 | Koike et al. |
| 6,797,347 | B2 | 9/2004 | Chow |
| 7,086,726 | B2 | 8/2006 | Takashima et al. |
| 2006/0051235 | A1 | 3/2006 | Christensen et al. |
| 2006/0058188 | A1 | 3/2006 | Tamagawa |

FOREIGN PATENT DOCUMENTS

| | | |
|---|---|---|
| KR | 20030027693 | 4/2003 |
| KR | 20060051235 | 5/2006 |
| KR | 20070103364 | 10/2007 |

OTHER PUBLICATIONS

European Patent Office, Extended European Search Report for EP08731687, dated Apr. 27, 2011, Hewlett-Packard Development Company, L.P. (Applicant).

Search Report from International Searching Authority for PCT/US2008/056237 dated Dec. 4, 2008.

*Primary Examiner* — Stephen Meier
*Assistant Examiner* — Alexander C Witkowski

(57) ABSTRACT

The present application relates to a surface treatment composition for inkjet media, including: starch; fluorescence whitening agent selected from the group consisting of nonionic, cationic, and anionic fluorescence whitening agents, and combinations thereof; metallic salt including cation and anion, the cations being selected from monovalent metal ions, multiple valent metal ions, and combinations and derivatives thereof, and the anions being selected from the group consisting of fluoride, chloride, iodide, bromide, nitrate, phosphate, chlorate, acetate, and combinations and derivatives thereof; and chemical chelant. The application also relates to a method of making surface-treated inkjet media, including providing a base stock including cellulose paper and applying a surface treatment composition to the base stock. The application also relates to a paper coated with the surface treatment composition and a system of inkjet printing with surface treated inkjet media.

25 Claims, 2 Drawing Sheets

COMPOSITION, METHOD AND SYSTEM FOR MAKING HIGH WHITENESS INKJET MEDIA

BACKGROUND

The present disclosure relates generally to a composition of, and a method for making high whiteness inkjet media.

Paper such as office inkjet paper or multi-use office papers are surface treated with sizing agents to achieve various objectives, such as preventing wicking, preventing feathering, and improving black optical density (KOD) and color gamut. The surface sizing solution usually contains chemicals such as modified or virginal starches, polymeric emulsions and other natural compounds with high molecular weight, synthetic surface sizing agents and other processing aid additives. To improve the optical appearance of the paper, fluorescent whitening agents (FWAs), also known as optical brightening agents (OBAs) may also be added into the surface sizing solution to increase brightness and whiteness of the paper. The metallic salts such as divalent metal salts have been added to the size press solution as the ink fixation agents. Thus, the pigment-based ink performance has been significantly improved. Printing attributes such as KOD, dry time and color saturation are significantly improved.

BRIEF DESCRIPTION OF THE DRAWINGS

Features and advantages of embodiments of the present disclosure will become apparent by reference to the following detailed description and drawings, in which.

DETAILED DESCRIPTION

Figure 1:
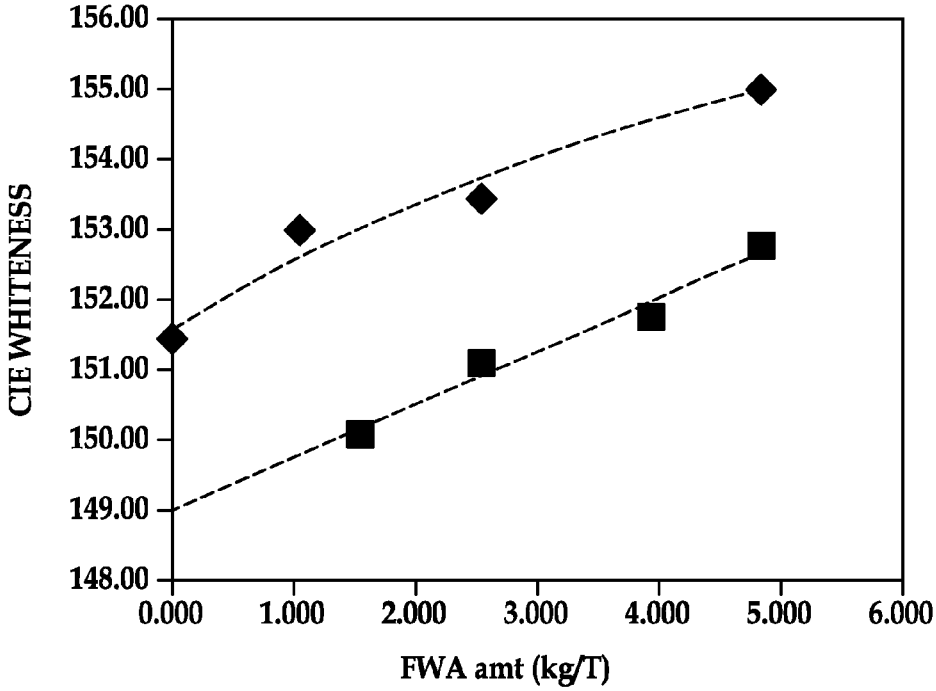
FIG. 1 is a graph comparing FWA amount and CIE whiteness in an example of the present application.

Metallic salts such as divalent metal salts have been added to the size press solution as the ink fixation agents, and, thus, pigment based ink performance has been significantly improved. As mentioned above, printing attributes such as KOD, dry time and color saturation are thus significantly improved. In this past practice, however, when metal salt is added to the surface sizing solution with FWAs and other typical additives, a negative effect on brightness and whiteness was often seen. The salts usually strongly quench the effectiveness of FWAs. A low grade of salt often contains metal contaminants such as $Fe^{+++}$ and $Cu^{++}$ ions, which may drastically degrade paper brightness and whiteness. To maintain brightness and whiteness of the paper when salts are added with FWAs, the dosage of the optical brightening agents has to be increased. The increase of FWAs not only results in significantly higher cost, but excessive FWA may cause a "greening" effect, which alters the color hue of the paper.

The present application relates to a surface treatment composition for treating the paper substrate to improve substrate performance with inkjet printing, especially for pigment-based ink.

The composition includes metallic salts and chemical chelants. Other common size press additives such as starch, binder, filler, surface sizing agent, FWA, pH control, and other processing aid agents can also be included.

It is desirable to provide low cost but high quality media which creates better print outcomes. To achieve this goal, the metallic salts, especially multi-valent salts, e.g., divalent salts, such as calcium chloride, have been used as additives in surface sizing processing. The salts crash out the pigment dispersions from ink solutions, and cations interact with anionic particles of colorants so that the pigmented colorant stays on the outermost surface layer of the media. This technology increases the optical density and color saturation of the image and reduces dry time. It also improves the print quality by sharpening dot edge and reduces "ink strike through" so that good image quality is obtained when the sheet is printed double-sided. These improvements are especially true when using a printer that is designed for pigmented inks. The potential drawback of this technology is the quench effect of the salt on the FWA of the paper. To improve the appearance of the paper with higher brightness and whiteness, FWA is usually added to the surface sizing solution. FWAs are fluorescent dyes or pigments that absorb ultraviolet radiation and reemit it at a higher wavelength in the visible spectrum (blue), thereby resulting in a whiter, brighter appearance to the paper sheet. Representative FWAs include, but are not limited to: azoles; biphenyls; coumarins; furans; ionic brighteners, including anionic, cationic, and anionic (neutral) compounds; naphthalimides; pyrazenes; substituted (e.g., sulfonated) stilbenes; salts of such compounds including but not limited to alkali metal salts, alkaline earth metal salts, transition metal salts, organic salts and ammonium salts of such brightening agents; and combinations of one or more of the foregoing agents.

As discussed above, the salts generally strongly quench the effectiveness of FWAs. The effectiveness of FWAs may also be very sensitive to the ionic contamination of the salts, especially impurities such as some heavy metal ions like copper, chromium, cobalt, nickel, zinc, cadmium and iron ions, which often reside in low grade salts. The CIE whiteness, for example, can drop as much as 1-3 units, even with the addition of food grade salts (low contaminant salt). (CIE whiteness is a measurement of whiteness which is expressed as a single number. The CIE whiteness standard most commonly used, and which is used in this application, is the standard developed by the International Commission on Illumination based in France.) Sometimes the loss of whiteness/brightness cannot even be compensated for by adding extra amounts of costly FWA. Furthermore, such extra amounts of FWA generally cause a "greening" effect to the paper.

A solution to the problem has been found and is disclosed herein. Chemical chelant, as a non-limiting example, the chemical commercially available under the trade name EXTRA WHITE™, manufactured by Nalco Inc., of Naperville, Ill., USA, can be incorporated into the surface sizing solution containing metallic salts. By this means, the brightness and whiteness of the paper can be maintained at the same level as the paper which contains no salts. Even less FWA is then required to achieve and maintain the desired brightness and whiteness levels. Thus, cost savings are achieved while quality is increased. With this composition, higher brightness or whiteness can be achieved, to the point of achieving maximal brightness targets, while reducing as much as about 50% of the FWA used. As described in Examples 2 and 3 below, levels of CIE Whiteness of from about 152.00 to about 156.00 can be achieved with a paper.

In an embodiment, the chelant is a compound selected from the group consisting of organic phosphonate, phosphate, carboxylic acids, dithiocarbamates, salts of any of the previous members, and any combinations thereof.

"Organic phosphonates" mean organic derivatives of phosphonic acid. Non-limiting examples include $HP(O)(OH)_2$, containing a single C—P bond, such as HEDP($CH_3C(OH)(P(O)(OH)_2)$, 1-hydroxy-1,3-propanediylbis-phosphonic ($(HO)_2P(O)CH(OH)CH_2CH_2P(O)(OH)_2$)); preferably containing a single C—N bond adjacent (vicinal) to the C—P bond, such as DTMPA ($(HO)_2P(O)CH_2N[CH_2CH_2N(CH_2P(O)(OH)_2)_2]_2$), AMP($N(CH_2H(O)(OH)_2)_3$), PAPEMP ($(HO)_2P(O)CH_2)_2NCH(CH_3)CH_2(OCH_2CH(CH_3))_2N(CH_2)_6N(CH_2P(O)(OH)_2)_2$), HMDTMP($(HO)_2P(O)CH_2)_2N(CH_2)_6N(CH_2P(O)(OH)_2)_2$), HEBMP($N(CH_2P(O)(OH)_2)_2CH_2CH_2OH$), and the like.

"Organic phosphates" mean organic derivatives of phosphorous acid, $P(O)(OH)_3$, containing a single C—P bond. Non-limiting examples include triethanolamine tri(phosphate ester) ($N(CH_2CH_2OP(O)(OH)_2)_3$), and the like.

"Carboxylic acids" mean organic compounds containing one or more carboxylic group(s), —C(O)OH. Non-limiting examples include aminocarboxylic acids containing a single C—N bond adjacent (vicinal) to the C—$CO_2H$ bond, such as EDTA ($(HO_2CCH_2)_2NCH_2CH_2N(CH_2CO_2H)_2$), DTPA ($(HO_2CCH_2)_2NCH_2CH_2N(CH_2CO_2H)CH_2CH_2N(CH_2CO_2H)_2$), and the like and alkaline and alkaline earth metal salts thereof.

"Dithiocarbamates" include, as non-limiting examples, monomeric dithiocarbamates, polymeric dithiocarbamates, polydiallylamine dithiocarbamates, 2,4,6-trimercapto-1,3,5-triazine, disodium ethylenebisdithiocarbamate, disodium dimethyldithiocarbamate, and the like. In an embodiment, the chelant is a phosphonate. In a further embodiment, the phosphonate is diethylene-triamine-pentamethylene phosphonic acid (DTMPA) and salts thereof. In an embodiment, the chelant is a carboxylic acid. In a further embodiment, the carboxylate is selected from diethylenetriaminepentaacetic acid (DTPA) and salts thereof, and ethylenediaminetetraacetic acid (EDTA) and salts thereof. Sulfites and phosphines with S—O and P—O bonds, respectively, can also be compounded in chemical chelant compositions.

For purposes of inkjet printing media which is printed with pigmented inks, water-soluble or water-dispersible metallic salts are used as the ink fixative in the surface treatment composition. The metallic salts may include water-soluble mono- or multi-valent metallic salts. In an embodiment, multi-valent metallic salts are used. The metallic salt may include cations of monovalent metal ions, multiple valent metal ions, combinations and derivatives thereof. Examples include Group I metals, Group II metals, and Group III metals. Non-limiting examples include metal cations such as potassium, sodium, calcium, magnesium, barium, strontium, and aluminum ions. The metallic salt may include anions such as fluoride, chloride, iodide, bromide, nitrate, chlorate, acetate ions, various combinations and derivatives thereof. Anions which are known to readily interact and bind with the paper pulp are excluded from use with the metallic salt. Such anions include, as non-limiting examples, anions based on sulfur and phosphorous. In an embodiment, the metallic salts have cations such as calcium, magnesium, aluminum, and combinations and derivatives thereof. The effective amount of water-soluble and/or water dispersible metallic salts used in the surface treatment composition is decided by the type of ink, amount of surface treatment composition applied to base paper stock, and type of base paper stock. In an embodiment of the present disclosure, the amount of water-soluble and/or water-dispersible metallic salts can be in a range of 1 kg per metric ton (T) of dry base paper stock to 25 kg/T. In an embodiment, the amount of metallic salts ranges from about 1 kg/T to about 15 kg/T.

As part of the surface treatment composition, the sizing agents are added to the paper to aid in the development of a resistance to penetration of liquids through the paper. Sizing agents can be starch; carboxymethylcellulose (CMC); polyvinyl alcohol; methyl cellulose; alginates; waxes; wax emulsions; alkyl ketene dimer (AKD); alkyl succinic anhydride (ASA); alkenyl ketene dimer emulsion (AnKD); emulsions of ASA or AKD with cationic starch; ASA incorporating alum; and combinations of such sizing agents. The surface sizing agent is added to the substrate via the size press operation in the manufacturing process of paper.

In one embodiment, the starch is used as a sizing agent. Examples of starches are corn starch, tapioca starch, wheat starch, rice starch, sago starch and potato starch. These starch species can be unmodified starch, enzyme modified starch, thermal and thermal-chemical modified starch and chemical modified starch. In one embodiment, the chemical modified starch is used, which includes, but is not limited to, converted starches such as acid fluidity starches, oxidized starches and pyrodextrins; derivatized starches such as hydroxyalkylated starches, cyanoethylated starch, cationic starch ethers, anionic starches, starch esters, starch grafts, and hydrophobic starches. Non-limitative examples of other suitable surface sizing agents also include styrene based emulsion polymers, AKD, and/or combinations thereof.

The substrate used to make high brightness inkjet paper can include cellulose fibers. The type of fiber is not critical, and any such fiber known for use in paper making can be used. For example, the substrate can be made from pulp fibers derived from hardwood trees, softwood trees, or a combination of hardwood and softwood trees prepared for use in papermaking fiber furnish by any known suitable digestion, refining, and bleaching operations as are, for example, known in mechanical, thermomechanical, chemical and semichemical, etc., pulping and other well-known pulping processes. The term "hardwood pulps" refers to fibrous pulp derived from the woody substance of deciduous trees (angiosperms) such as birch, oak, beech, maple, and eucalyptus. The term "softwood pulps" refers to fibrous pulps derived from the woody substance of coniferous trees (gymnosperms) such as varieties of fir, spruce, and pine, as for example loblolly pine, slash pine, Colorado spruce, balsam fir and Douglas fir. In certain embodiments, at least a portion of the pulp fibers may be provided from non-woody herbaceous plants including, but not limited to, kenaf, hemp, jute, flax, sisal, or abaca. Either bleached or unbleached pulp fiber may be utilized in the process of this disclosure. Recycled pulp fibers are also suitable for use. In an embodiment, the cellulosic fibers in the paper include from about 30% to about 100% by weight hardwood fibers and from about 0% to about 70% by weight softwood fibers.

Additionally, a number of fillers may be included in the above-mentioned pulps during formation of the substrate. According to one exemplary embodiment, the fillers that may be incorporated into the pulp to control physical properties of the final substrate include, but are in no way limited to, ground calcium carbonate, precipitated calcium carbonate, titanium dioxide, kaolin clay, and silicates. As incorporated in the present example system and method, the amount of fillers may vary widely. However, according to one embodiment, the fillers represent from approximately 0% to approximately 40% by weight of the dry fibers; and according to another embodiment, the filler represents from approximately 10% to approximately 20% by weight of the dry fibers.

In one embodiment, an inkjet printing media of the present application includes a base stock such as a cellulose paper, and a surface treatment composition applied on a single side or on both sides of the base stock. The cellulose base paper may have a basis weight ranging from about 35 gsm to about 250 gsm. The base paper can contain wood pulp (groundwood pulp, thermomechanical pulp, and chemo-thermomechanical pulp) and/or wood-free pulp.

In an embodiment of the present application, the surface treatment composition includes a starch such as corn starch, tapioca starch and potato starch or other water soluble or water dispersible binders. These starch species can be unmodified starch, enzyme modified starch, thermal and thermal-chemical modified starch, chemical modified starch, and combinations thereof.

The surface treatment composition also contains FWA, which can be either non-ionic FWA, cationic FWA or anionic FWA (di-sulphonated, tetra-sulphonated and hexa-sulphonated).

As previously discussed, the salts used in surface treatments can be any kind of mono-valent and/or multi-valent metallic salts including inorganic and organic salts, co-salts with metal counterparts, multiple anionic counterparts and/or combinations thereof. These salts can be in liquid form and/or solid form, but are water soluble. Non-limiting examples of these salts can be, but are not limited to, combinations of cations and anions, for example, any of the cations: such as calcium, magnesium and aluminum, combined with any of the anions: such as fluoride, chloride, iodide, bromide, nitrate, chlorate, and acetate. They can be in any grade (purity). In an embodiment, the class with lower amounts of heavy metal ionic contamination such as $Fe^{++}$, $Fe^{+++}$, $Cu^{+}$, $Cu^{++}$ is used.

The chemical chelant used in surface treatment composition was EXTRA WHITE™ supplied by Nalco Inc., of Naperville, Ill., USA.

Optionally, some synthetic surface sizing agents (SSA) can be used in the surface treatment composition. The examples of these SSA are styrene acrylate emulsion, styrene maleic anhydride copolymer, styrene acrylic acid copolymer, polyurethane dispersions and ethylene acrylic acid copolymer, or combinations thereof. Other components can also be used in the surface treatment composition. They are, but are not limited to, color dye, defoamer, pH buffer and inorganic filler particles.

A typical formulation of the surface treatment composition may include (as a non-limiting example):

salts such as calcium, magnesium and aluminum salts: about 1-25 kg/T of paper substrate;

chemical chelants: about 0.5-20 kg/T of paper substrate (as a non-limiting example EXTRA WHITE™ from Nalco Inc.);

starch: about 15-100 kg/T of paper substrate;

FWA: about 0.5-30 kg/T of paper substrate; and surface sizing agent: about 0-5 kg/T of paper substrate.

The results showed that with the existence of salt, the chemical chelants had higher effectiveness to promote sheet whiteness in the lower pH range. With the fact that most paper is required to be sold as "acid-free" paper, it is desirable to keep the system pH in the weak alkaline range.

Among the positive effects that can be achieved with the present application are the following:

reducing FWA usage up to 50% with high brightness paper;

having the opportunity to use low grades of salt without increasing FWA demand; and achieving a high brightness target substantially without suffering "greening" effects.

To further illustrate embodiment(s) of the present disclosure, various examples are given herein. It is to be understood that these examples are provided for illustrative purposes and are not to be construed as limiting the scope of the disclosed embodiment(s).

EXAMPLE 1

A series of inkjet printing media were prepared using the following procedure:

(A) The substrates used in this experiment were made on a paper machine from a fiber furnish consisting of 30% softwood and 50% hardwood fibers and 12% precipitated calcium carbonate with alkenyl succinic anhydride (ASA) internal size. The basis weight of the substrate paper was about 75 gsm.

(B) The surface sizing composition was prepared in the lab using a low shear mixer. The starch was firstly pre-cooked at 95° C. for 2 hrs and cooled to room temperature. A certain amount of pre-cooked starch was added to the mixing container, then the water, and then the water soluble divalent metal salt under proper shear actions. The desired amount of FWA chemicals were also added to the mixing container. Right before applying surface sizing composition on the substrate, the chemical chelant agent was added to the mixture.

(C) Size press treated inkjet media was prepared by applying surface sizing composition either by hand drawdown using a Mayer rod, or a continuous lab coater. By controlling the formulation solids, rod size or nip pressure, and machine running speed, a pickup weight of about 0.5 to 3.0 gsm per side was achieved. The treated sheets were dried in a hot air oven of 100° C. for 1 hr.

EXAMPLE 2

Two comparative surface treatment compositions were prepared as shown in Table 1. Formulation A1 contained 7.5 kg/T (paper substrate) salt, calcium chloride, and 7.0 kg/T (paper substrate) of chelant agent as supplied by Nalco Inc, of Naperville Ill., USA under the trademark EXTRA WHITE™ NW1. Formulation B1 had the same components but contained no chemical chelant agent. A FWA supplied by Clariant, Inc. under the tradename of Leucophor NS Liq was used in both formulations in various loading amounts. FIG. 1 indicates the dependence of CIE whiteness vs. FWA amount. Formulation A1 containing chelant showed the higher CIE whiteness compared with Formulation B1 without chelant, in an average of 1-3 units. FIG. 1 shows two curves achieved by plotting points for Formulation A1 ("diamond symbol") and B1 ("square symbol") on a graph in which the X axis is the amount of FWA, and the Y axis is the CIE Whiteness. As shown in FIG. 1, the combination of Formulation A1 achieved improved image quality with the salt and compensated with chelant agent for whiteness loss due to the quenching effect of the salt. In comparison, the combination of Formulation B1 did not achieve such improved image quality.

TABLE 1

| | A1 | B1 |
|---|---|---|
| Hydroxyl ethylated corn starch | 55 kg/ton | 55 kg/ton |
| FWA | Various | Various |
| Calcium chloride | 7.5 kg/ton | 7.5 kg/ton |
| EXTRA WHITE ™ NW1 | 7 kg/ton | 0 |

EXAMPLE 3

Figure 2:
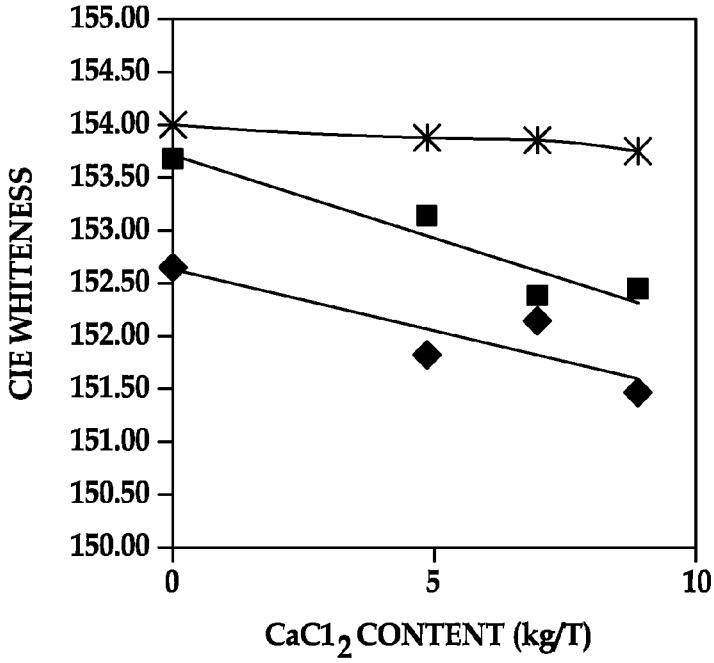
FIG. 2 is a graph comparing $CaCl_2$ content and CIE whiteness in an example of the present application.

Comparative surface treatment compositions were prepared as shown in Table 2. FIG. 2 shows the results of formulation listed in Table 2 in whiteness change with salt concentration when different amounts of chelant agent, EXTRA WHITE™ NW1, were added to samples. FIG. 2 shows that metallic salt was able to quench the FWA effectiveness by dropping CIE whiteness 1-units (A2) ("diamond" symbol)(0 kg/T of EXTRA WHITE™ added). The use of chemical chelant blocked the negative effects of ionic contamination, and the CIE whiteness is compensated and even higher than the system without using salt, since chemical chelant has retardant effect to the yellowing of fiber itself (B2) ("square" symbol)(4.9 kg/T of EXTRA WHITE™ added). In the formulation of high dosage chemical chelant (C2) ("star" symbol), the CIE whiteness is almost independent of salt concentration (8.9 kg/T of EXTRA WHITE™ added).

TABLE 2

| | A2 | B2 | C2 |
|---|---|---|---|
| Hydroxyl ethylated corn starch | 55 kg/ton | 55 kg/ton | 55 kg/ton |
| FWA | 3 kg/ton | 3 kg/ton | 3 kg/ton |
| Calcium chloride | Various | Various | Various |
| EXTRA WHITE ™ NW1 | 0 kg/ton | 4.9 kg/ton | 8.9 kg/ton |

EXAMPLE 4

Figure 3:
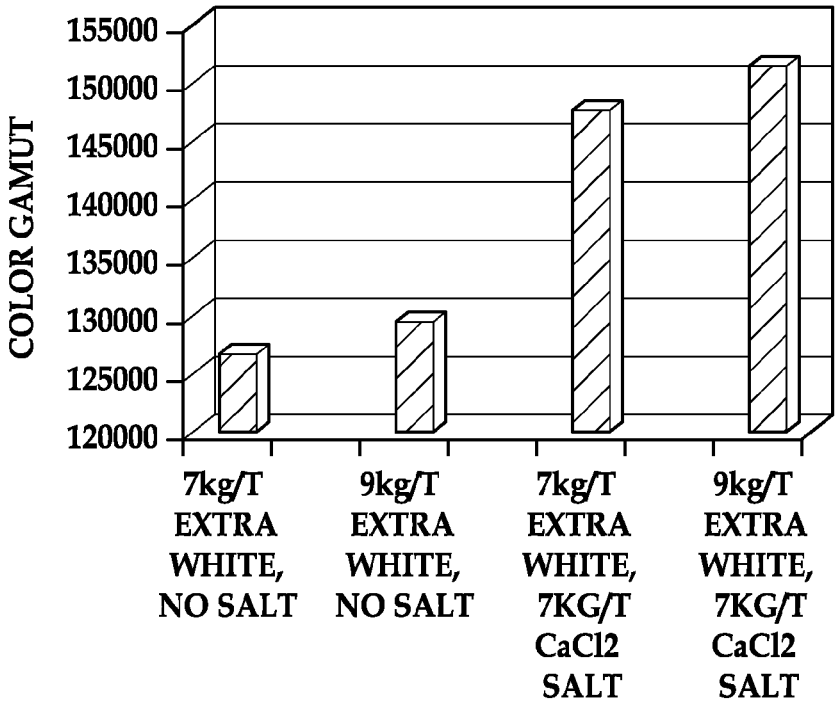
FIG. 3 is a bar graph showing differences in color gamut achieved with and without metal salt in an example of the present application.

Samples were prepared in order to show the differences in terms of color gamut and black optical density between samples with metallic salt and without metallic salt. The samples loaded with $CaCl_2$ and without $CaCl_2$, as made by the methods described in Example 1, were printed using HP PhotoSmart Pro B9180, manufactured by Hewlett-Packard Co. The color gamut of each printed image was recorded, and the results are provided as a bar graph in FIG. 3, with the y axis gauging increasing amounts of C L*a*b* volume, a measure of color gamut. The color gamut measurements were carried out on squares of primary color (cyan, magenta, and yellow) and secondary colors (red, green, and blue) plus white (un-imaged sheets) and black colors. L*a*b* values were obtained from the measurement and thereafter were used to calculate the 8-point color gamut, where the higher value of color gamut indicates that the prints showed richer or more saturated colors. As shown in FIG. 3, the color gamut measurements showed significantly higher in terms of color gamut in the sample with $CaCl_2$. Chemical chelant EXTRA WHITE™ appeared to give no help in promoting color gamut.

Figure 4:
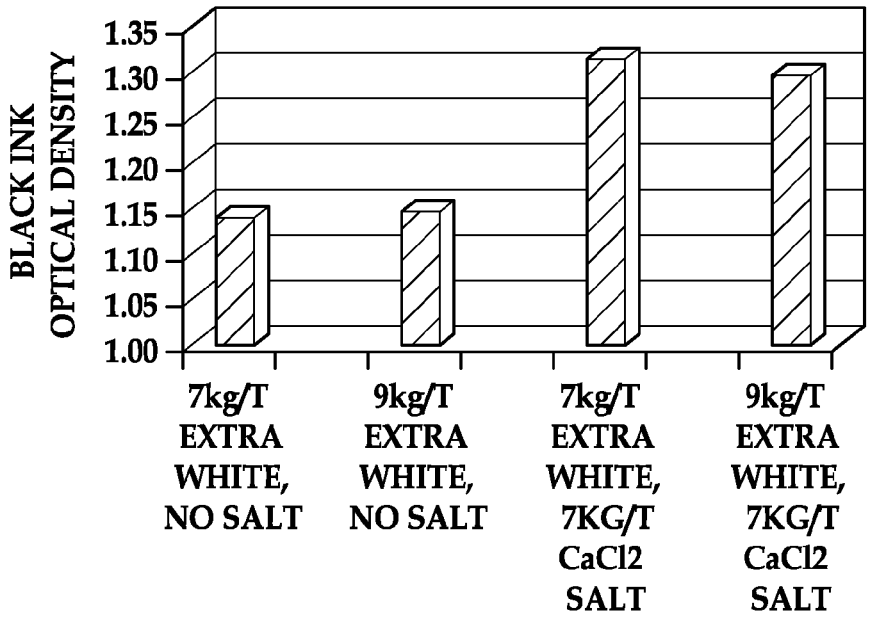
FIG. 4 is a bar graph showing differences in black optical density achieved with and without metal salt in an example of the present application.

The black optical density (KOD) measurements were carried out on the same samples from above, using an X-Rite densitometer to measure the blackness of the area filled. The results are provided in FIG. 4, a bar graph, with the y axis gauging increasing amounts of KOD. The higher value, that of the samples with $CaCl_2$, indicated a darker printing effect than the samples with only chemical chelant.

While several embodiments have been described in detail, it will be apparent to those skilled in the art that the disclosed embodiments may be modified. Therefore, the foregoing description is to be considered exemplary rather than limiting.

What is claimed is:

1. A surface treatment composition for inkjet media, comprising:

starch;

fluorescence whitening agent selected from the group consisting of nonionic, cationic, anionic fluorescence whitening agents, and combinations thereof;

metallic salt including cation and anion, the cation selected from monovalent metal ions, multiple valent metal ions, and combinations and derivatives thereof; and the anion selected from the group consisting of fluoride, chloride, iodide, bromide, nitrate, chlorate, acetate, and combinations and derivatives thereof; and chemical chelant.

2. The surface treatment composition of claim 1 wherein the starch comprises from about 15 kg/T to about 100 kg/T of the inkjet media, the fluorescence whitening agent comprises from about 0.5 kg/T to about 30 kg/T of the inkjet media, the metallic salt comprises from about 1 kg/T to about 25 kg/T of the inkjet media, and the chemical chelant comprises from about 0.5 kg/T to about 20 kg/T of the inkjet media.

3. The surface treatment composition of claim 1 wherein the metallic salt is water soluble, and the cation of the metallic salt is selected from the group consisting of potassium, sodium, calcium, magnesium, barium, aluminum, strontium, derivatives thereof, and combinations thereof.

4. The surface treatment composition of claim 1 wherein the starch is selected from the group consisting of corn starch, tapioca starch, wheat starch, rice starch, sago starch, potato starch, and combinations thereof.

5. The surface treatment composition of claim 1 wherein the starch is selected from the group consisting of unmodified starch, enzyme modified starch, thermal modified starch, thermal-chemical modified starch, chemical modified starch, and combinations thereof.

6. The surface treatment composition of claim 1 wherein the metallic salt amount is from about 1 kg per metric ton to about 15 kg per metric ton of the inkjet media.

7. The surface treatment composition of claim 1 wherein the fluorescence whitening agent is selected from di-sulphonated fluorescence whitening agent; tetra-sulphonated fluorescence whitening agent; and hexa-sulphonated fluorescence whitening agent.

8. The surface treatment composition of claim 1 wherein the surface treatment composition further includes surface sizing agents selected from the group consisting of: styrene acrylate emulsion, styrene maleic anhydride copolymer, styrene acrylic acid copolymer, polyurethane dispersions, ethylene acrylic acid copolymer, and combinations thereof.

9. The surface treatment composition of claim 1 wherein the chelants are selected from the group consisting of organic phosphonate, organic phosphonate salts, phosphate, phosphate salts, carboxylic acids, carboxylic acid salts, dithiocarbamates, dithiocarbamate salts, sulfites, phosphines, and combinations thereof.

10. Inkjet printable paper comprising a surface coated with a surface treatment composition as described in claim 1.

11. The inkjet printable paper of claim 10 wherein the surface coated with the surface treatment composition has a CIE Whiteness Number from 152.00 to 156.00.

12. A method of making surface-treated inkjet media, comprising:

providing a base stock including cellulose paper;

applying a surface treatment composition to the base stock, the surface treatment composition including: starch; fluorescence whitening agent selected from the group consisting of nonionic, cationic, anionic fluorescence whitening agents, and combinations thereof; metallic salt including cation and anion, the cation being selected from monovalent metal ions, multiple valent metal ions, and combinations and derivatives thereof, and the anion being selected from the group consisting of fluoride, chloride, iodide, bromide, nitrate, phosphate, chlorate, acetate, and combinations and derivatives thereof; and chemical chelant.

13. The method of claim 12 wherein the metallic salt cation is selected from the group consisting of potassium, sodium, calcium, magnesium, barium, aluminum, strontium, and combinations and derivatives thereof.

14. The method of claim 12 wherein the fluorescence whitening agent is selected from di-sulphonated fluorescence whitening agent; tetra-sulphonated fluorescence whitening agent; and hexa-sulphonated fluorescence whitening agent.

15. The method of claim 12 wherein the surface treatment composition further includes surface sizing agents selected from the group consisting of: styrene acrylate emulsion, styrene maleic anhydride copolymer, styrene acrylic acid copolymer, polyurethane dispersions, ethylene acrylic acid copolymer, and combinations thereof.

16. The method of claim 12 wherein the chelants are selected from the group consisting of organic phosphonate, organic phosphonate salts, phosphate, phosphate salts, carboxylic acids, carboxylic acid salts, dithiocarbamates, dithiocarbamate salts, sulfites, phosphines, and combinations thereof.

17. A system of inkjet printing with surface treated inkjet media, comprising:

an inkjet printer;

pigment based ink;

an inkjet media comprising a surface treatment composition including: starch; fluorescence whitening agent selected from the group consisting of nonionic, cationic, anionic fluorescence whitening agents, combinations and derivatives thereof; metallic salt including cation and anion, the cation being selected from monovalent metal ions, multiple valent metal ions, and combinations and derivatives thereof, the anion being selected from the group consisting of fluoride, chloride, iodide, bromide, nitrate, phosphate, chlorate, acetate, and combinations and derivatives thereof; and chemical chelant.

18. The system of claim 17 wherein the starch comprises from about 15 kg/T to about 100 kg/T of the inkjet media, the fluorescence whitening agent comprises from about 0.5 kg/T to about 30 kg/T of the inkjet media, the metallic salt comprises from about 1 kg/T to about 25 kg/T of the inkjet media, and the chemical chelant comprises from about 0.5 kg/T to about 20 kg/T of the inkjet media.

19. The system of claim 17 wherein the cation of the metallic salt is selected from the group consisting of potassium, sodium, calcium, magnesium, barium, aluminum, strontium, and combinations and derivatives thereof.

20. The system of claim 17 wherein the starch is selected from the group consisting of corn starch, tapioca starch, wheat starch, rice starch, sago starch, potato starch, and combinations thereof.

21. The system of claim 17 wherein the starch is selected from the group consisting of unmodified starch, enzyme modified starch, thermal modified starch, thermal-chemical modified starch, chemical modified starch, and combinations thereof.

22. The system of claim 17 wherein the metallic salt amount is from 1 kg per metric ton to 15 kg per metric ton of the inkjet media.

23. The system of claim 17 wherein the fluorescence whitening agent is selected from di-sulphonated fluorescence whitening agent, tetra-sulphonated fluorescence whitening agent, and hexa-sulphonated fluorescence whitening agent.

24. The system of claim 17 wherein the surface treatment composition further includes surface sizing agents selected from the group consisting of: styrene acrylate emulsion, styrene maleic anhydride copolymer, styrene acrylic acid copolymer, polyurethane dispersions, ethylene acrylic acid copolymer, and combinations thereof.

25. The system of claim 18 wherein the chelants are selected from the group consisting of organic phosphonate, organic phosphonate salts, phosphate, phosphate salts, carboxylic acids, carboxylic acid salts, dithiocarbamates, dithiocarbamate salts, sulfites, phosphines, and combinations thereof.

* * * * *